US005651353A

United States Patent [19]

Allston

[11] Patent Number: 5,651,353

[45] Date of Patent: Jul. 29, 1997

[54] INTERNAL COMBUSTION ENGINE CONTROL

[75] Inventor: Brian Keith Allston, Rochester, N.Y.

[73] Assignee: General Motors Corporation, Detroit, Mich.

[21] Appl. No.: 647,844

[22] Filed: May 3, 1996

[51] Int. Cl.[6] ..... F02D 41/00

[52] U.S. Cl. ..... 123/673

[58] Field of Search ..... 123/673, 676, 123/679, 694, 434; 364/431.05, 431.03, 431.04, 431.06, 431.07

[56] References Cited

U.S. PATENT DOCUMENTS 4,869,222 9/1989 Klassen ..... 123/673
5,531,208 7/1996 Hasegawa et al. ..... 123/673
5,548,514 8/1996 Hasegawa et al. ..... 364/431.05
5,566,071 10/1996 Akazaki et al. ..... 364/431.05

*Primary Examiner*—Raymond A. Nelli
*Attorney, Agent, or Firm*—Michael J. Bridges

[57] ABSTRACT

Internal combustion engine air/fuel ratio control provides for individual engine cylinder air/fuel ratio balancing through sensing of individual cylinder air/fuel ratio and through comparison of sensed individual cylinder air/fuel ratio to a target air/fuel ratio with air/fuel ratio control command correction prescribed on a cylinder-by-cylinder basis. The target air/fuel ratio may be determined as an overall average cylinder actual air/fuel ratio. An additional control loop is provided for driving a value representing overall engine air/fuel ratio toward a desired air/fuel ratio, such as the stoichiometric ratio. Correction values are learned gradually for each engine cylinder and stored and recalled as a function of an engine operating level.

14 Claims, 4 Drawing Sheets

INTERNAL COMBUSTION ENGINE CONTROL

FIELD OF THE INVENTION

This invention relates to internal combustion engine control and, more particularly, to internal combustion engine individual cylinder air/fuel ratio balancing.

BACKGROUND OF THE INVENTION

Effective catalytic treatment of internal combustion engine emissions requires precise control of engine air/fuel ratio. Even minor deviations in engine air/fuel ratio away from the stoichiometric ratio can lead to significant increase in at least one of the undesirable emissions components of hydrocarbons HC, carbon monoxide CO, and oxides of nitrogen NOx. Conventional air/fuel ratio control approaches estimate actual engine air/fuel ratio through at least one central air/fuel ratio sensor and vary central control commands in response thereto. The estimate of actual air/fuel ratio is assumed to represent the air/fuel ratio of all cylinders of multi-cylinder engines. A common control command is varied in response to the estimate of actual air/fuel ratio and is indiscriminately applied for control of all engine cylinders. Variations in the air/fuel ratio sensor output signal away from an average or single representative value are treated as "noise" and are filtered out of control processes to arrive at a single value representative of the sensor output over a number of engine cylinder combustion events.

There exist significant variations in the manner in which engine intake air and fuel are distributed between the cylinders of multi-cylinder engines and in the manner the air and fuel are consumed in each cylinder, for example, due to geometry variations between cylinders, intake runners, fuel injectors, etc., which result in flow variations between engine cylinders. Such distribution variations can result in significant variation in air/fuel ratio between engine cylinders. Much of the variation in the output signal of the air/fuel ratio sensor may therefore not be "noise" but may include information on fuel or air distribution variation between engine cylinders. Such distribution variation leads to transient departure of the engine air/fuel ratio away from a target air/fuel ratio, such as the stoichiometric ratio, which can lead to reduced catalytic treatment effectiveness and increased emissions.

It would therefore be desirable to translate air/fuel ratio measurement information into an indication of individual cylinder air/fuel ratio and to control air/fuel ratio on a cylinder-by-cylinder basis to further reduce engine emissions.

SUMMARY OF THE INVENTION

The present invention is directed to individual cylinder air/fuel ratio sensing and control for internal combustion engine emissions reduction.

More specifically, measurements of engine exhaust gas are synchronized with individual engine cylinder events, such as exhaust events, and are attributed to individual engine cylinders having most recently exhausted combustion products. The measurements may be taken in proximity to the exhaust manifold for each individual cylinder, or in a central location through one or more air/fuel ratio sensors. A target cylinder air/fuel ratio is determined and the measurements for each cylinder compared thereto to determine individual cylinder air/fuel ratio deviation. Individual cylinder control commands are corrected to drive the actual cylinder air/fuel ratio toward the target cylinder air/fuel ratio.

In accord with a further aspect of this invention, the target cylinder air/fuel ratio is determined as a predetermined function of the exhaust gas measurements of a plurality of engine cylinders. Individual cylinder air/fuel ratio deviation then represents a deviation of an individual cylinder away from the air/fuel ratio of the plurality. The air/fuel ratio of each cylinder may then be balanced with that of the plurality of cylinders. In accord with a further aspect of this invention, an additional air/fuel ratio control process provides for overall engine air/fuel ratio control substantially independent of the individual cylinder air/fuel ratio balancing control process. With such an additional control process, overall engine air/fuel ratio is driven to a target air/fuel ratio, such as the stoichiometric ratio in an absolute air/fuel ratio control process, while individual cylinder air/fuel ratio is balanced in a relative air/fuel ratio control process.

In accord with yet a further aspect of this invention, a reference cylinder is defined and is controlled only under the absolute air/fuel ratio control process, to provide for an anchoring of the cylinders controlled under the relative air/fuel ratio control process to minimize drift in the air/fuel ratio correction applied to individual cylinders in the relative air/fuel ratio control process.

In accord with yet a further aspect of this invention, the individual cylinder control command correction determined through the relative air/fuel ratio control process are stored as a function of engine operating conditions in an array of corrections for each applicable engine cylinder. The stored correction information is gradually updated in accord with individual cylinder air/fuel ratio control performance in a learning process so as to maintain a knowledgebase for each cylinder's air/fuel ratio control characteristic and to update each such knowledgebase as control conditions change.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
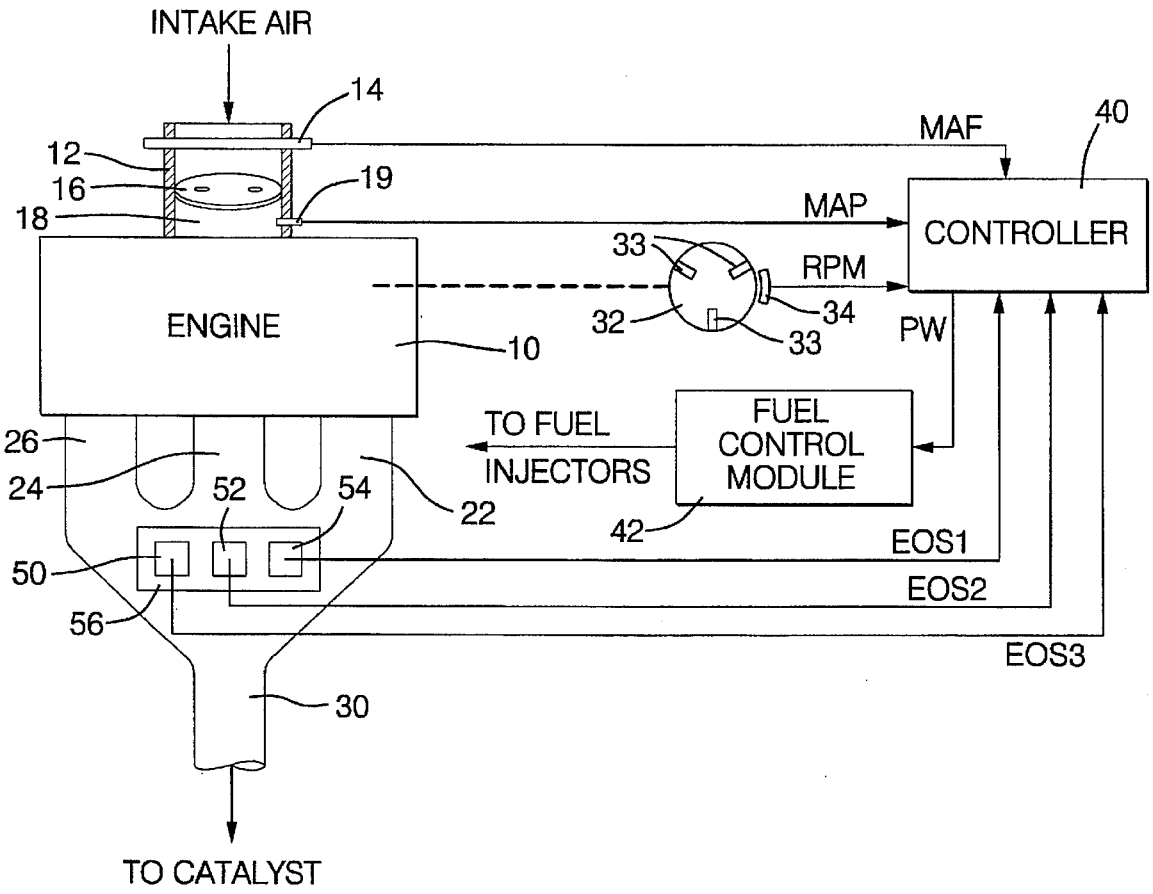
FIG. 1 is a general diagram illustrating schematically an internal combustion engine and engine control hardware for carrying out the preferred embodiment of this invention.

Referring to FIG. 1, internal combustion engine 10 receives intake air through intake air bore 12 in which is disposed mass airflow sensor 14 of any conventional type, such as the hot wire or thick film type, and in which is disposed intake air valve 16, such as a butterfly or rotary valve the position of which corresponds to a degree of restriction of the intake air bore to passage of intake air therethrough and into an intake manifold 18 for distribution, via a plurality of intake runners, to a plurality of engine cylinders (not shown). A plurality of electronically controlled fuel injectors (not shown) of a conventional design are provided, such as one in the intake runner of each cylinder, for timed metering of fuel into the runner for mixing with the intake air and timed admission to the engine cylinders for combustion therein, the products of which combustion are guided out of each cylinder via an exhaust manifold having a plurality of exhaust gas runners including runners 22, 24, and 26 corresponding to three cylinders of the conventional six cylinder engine of this embodiment. The exhaust gas runners 22, 24, and 26 converge into exhaust gas conduit 30 which guides the exhaust gas from the engine cylinders to a catalyst (not shown) for catalytic treatment, as is generally understood in the art. Included in the runners, such as runners 22, 24, and 26 are engine air/fuel ratio sensors 50, 52, and 54, which take the form of conventional zirconium oxide sensors for sensing oxygen content in engine exhaust gas as an indication of engine air/fuel ratio. The sensor or sensors 50, 52, and 54 may take a variety of forms within the scope of this invention. For example, in this embodiment, a sensor is provided for each exhaust gas runner for sensing the oxygen content of exhaust gas passing through such runner. The sensors are of a flat plate design as is generally available in the art, such as the design described in U.S. Pat. No. 5,329,806, assigned to the assignee of this invention, and especially detailed in FIG. 5 and its corresponding text of such patent. For the three exhaust runners 22, 24, and 26 of FIG. 1, the flat plate sensors are to be integrated into a common package in this embodiment, wherein the sensors share a common substrate, housing, and heating element, but otherwise are comprised of independent components including independent sensing elements. Each of the sensors should be positioned so as to be exposed to the exhaust gas that passes through the corresponding exhaust runner with minimum "pollution" by exhaust gas passing through any other runner. Accordingly, the sensors 50, 52, and 54 of FIG. 1, sharing a common substrate 56 are positioned at the point of convergence of the corresponding three exhaust runners 26, 24, and 22. In this manner, the sensor may be mechanized with simplified packaging, with reduced variation between sensors due to common parts between the sensors, and with reduced cost.

Alternatively, the sensors may be provided in discrete packages disposed directly in the exhaust gas runner for the corresponding cylinder. For example, the sensor 50 of FIG. 1 would be packaged alone and placed directly in runner 26 upstream of the conduit 30. The sensor 52 would likewise be in a discrete package placed in runner 24 and sensor 54 would be in a discrete package in runner 22. The potential for packaging difficulties, part-to-part variation and cost increases of this alternative embodiment over that of the preferred embodiment would be offset, to some extent, by the reduction in exhaust gas sensing crosstalk that is likely with the preferred embodiment. Still further, for cost reduction, a single sensor may be positioned in the exhaust gas conduit 30 downstream of any of the runners 22, 24, or 26, for sensing air/fuel ratio of the engine cylinders. This invention requires some measure of individual cylinder air/fuel ratio, which may be provided through individual cylinder exhaust event synchronous or asynchronous sensor sampling, as will be described.

Returning to FIG. 1, the sensors 50, 52, and 54 of the preferred embodiment transduce individual cylinder exhaust gas oxygen content into respective output signals EOS1, EOS2, and EOS3. The combustion of the air/fuel mixture in the engine cylinders operates to rotate engine output shaft 32, which is a crankshaft in this embodiment having a plurality of teeth or notches 33 about its circumference. A conventional Hall effect or variable reluctance sensor 34 is positioned in proximity to the crankshaft and is fixed in position for transducing passage of the teeth or notches 33 into variations in sensor output signal RPM. The output signal RPM undergoes a signal cycle for each complete tooth or notch passage by the sensor 34, such that individual cycles of the signal RPM indicate a known rotational displacement of the output shaft 32 and the frequency of the signal RPM is proportional to rotational speed of the output shaft 32, also called engine speed.

A conventional single chip microcontroller 40 is provided for receiving sensor output signals, such as the described signals MAF, MAP, RPM, EOS1, EOS2, and EOS3 and, through execution of a series of stored control, diagnostic and maintenance routines, generates and applies control, diagnostic and maintenance commands, such as to conventional automotive actuators and indicators. Specifically, a fuel control command PW, in the form of a fixed frequency pulse width command, is output by the controller 40 to a fuel control module 42 for applying timed fuel injector control commands to active fuel injectors for admitting fuel to cylinder intake runners, as is generally understood in the art.

Figure 2:
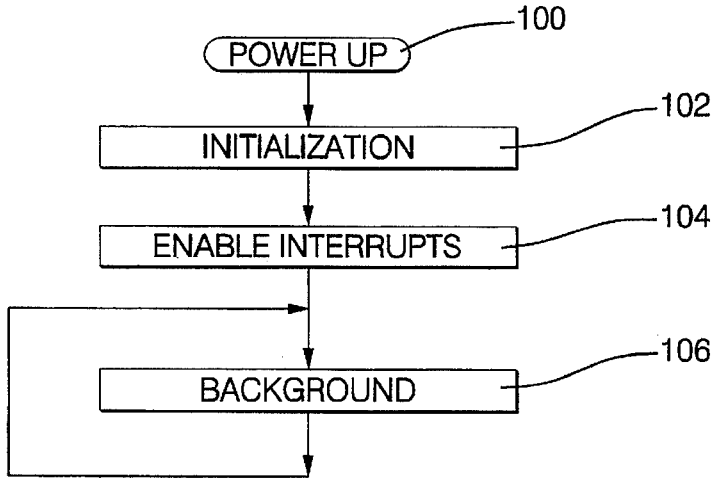
FIGS. 2, 3A, 3B, & C are computer flow diagrams illustrating a flow of operations for carrying out the preferred embodiment of this invention in accord with the hardware of FIG. 1.
Figure 3A:
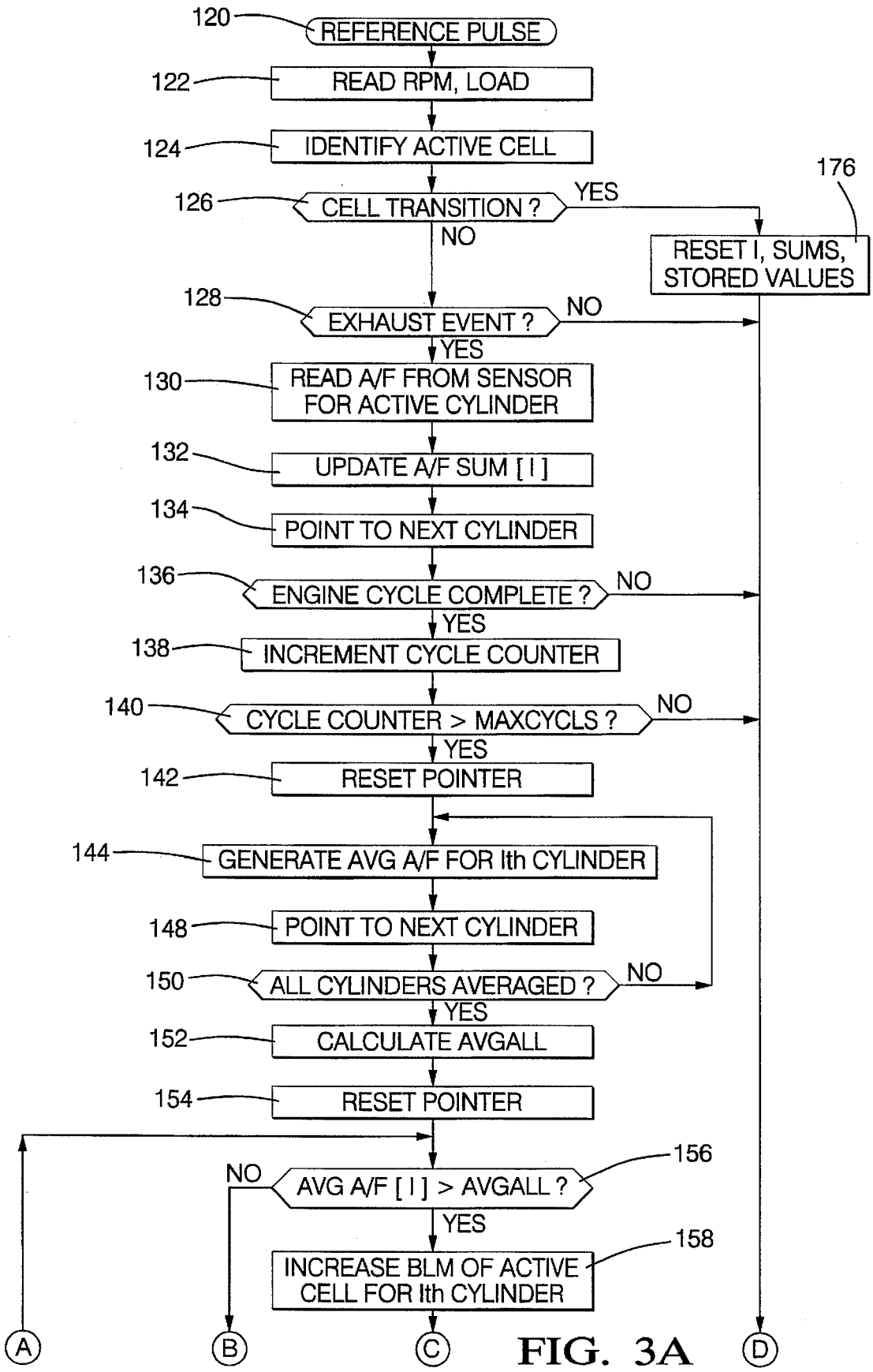
Figure 3B:
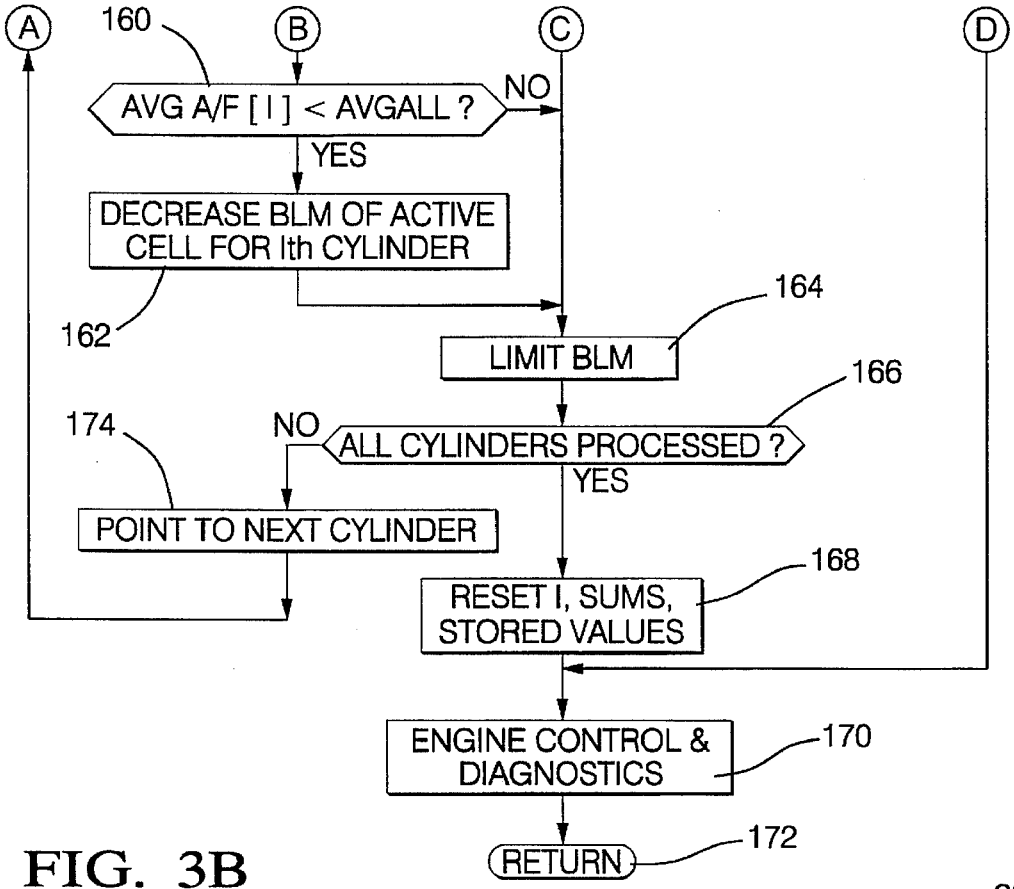
Figure 4:
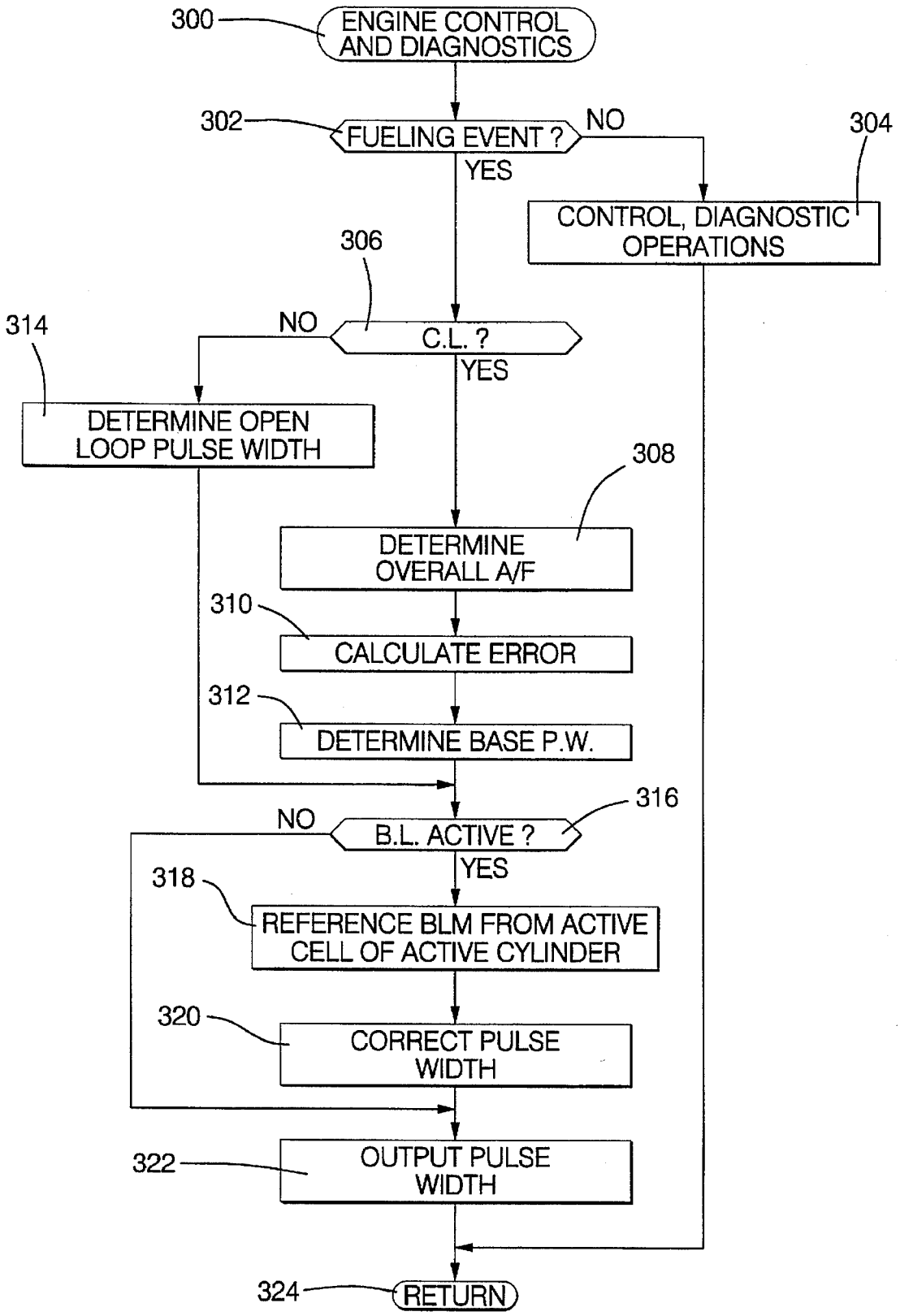

Among the routines carried out by the controller 40 are those of FIGS. 2–4 which are intended to include conventional control, diagnostic and maintenance operations as are generally understood as required for engine operation. Additionally, individual cylinder air/fuel ratio control operations are provided, as detailed through the operations of FIGS. 2–4.

For example, FIG. 2 illustrates operations executed, starting at a step 100, upon application of power to a controller at the start of an automotive vehicle ignition cycle, such as when a vehicle operator initially applies ignition power to the controller 40 of FIG. 1. The routine proceeds from step 100 to a step 102 to carry out initialization operations including clearing of memory locations and setting pointers, counters and flags to initial values. Event-based and timer-based interrupts are then enabled at a next step 104 including a reference pulse interrupt which is enabled to occur following passage of each tooth or notch 33 by the sensor 34 of FIG. 1. The event-based and timer-based interrupts will, once enabled at the step 104, occur following predetermined respective engine or time-based events. Background operations are next repeatedly carried out while ignition power is applied to the controller 40 (FIG. 1) at a step 106, including, for example, general maintenance operations of a low priority. Such background operations will be suspended upon occurrence of enabled interrupts to allow for servicing of the interrupts. When interrupt service operations are completed, the suspended background operations will resume.

Figure 5:
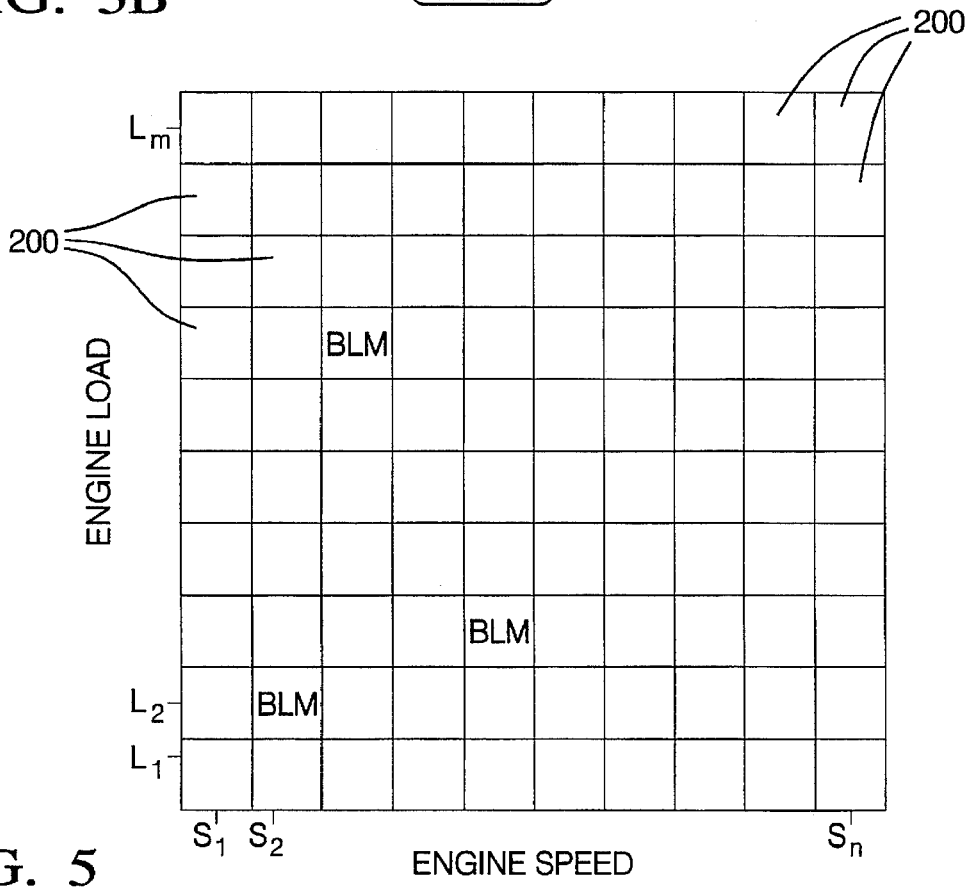
FIG. 5 is a general diagram illustrating a lookup table comprised of cells containing individual block learn multiplier values.

Service operations for the enabled reference pulse interrupt are illustrated in a step by step manner in FIG. 3, beginning, upon passage of a tooth or notch 33 by the sensor 34 of FIG. 1, at a step 120 and proceeding to a next step 122 to read current values for engine speed and load. Engine speed may be indicated by a filtered value of input signal RPM, and engine load may be proportional to a filtered MAF or MAP signal. An active cell is next identified at a step 124 as corresponding to the current speed and load values. Generally, as illustrated by the table of FIG. 5, a predetermined engine speed range is divided along its range by n speed values S1, S2, . . . , Sn, into n−1 speed regions and a predetermined engine load range is divided along its range by m load values L1, L2 . . . , Lm into m−1 load regions. The speed and load regions are combined to form a two-dimensional table having m*n entries or cells, such as representative cells 200, with each cell corresponding to a specific speed region and a specific load region. The active speed-load region or cell is that including the current speed and the current load, as determined at the step 122 of FIG. 3. In this embodiment, each engine cylinder, with the exception of a reference cylinder, has its own two-dimensional speed-load table with each cell of each table including a block learn multiplier value BLM used to modify fueling commands. Each BLM value may gradually be modified in accord with the required correction at the corresponding speed and load for balanced air/fuel ratio between engine cylinders, as will be described.

After identifying the active cell at the step 124 of FIG. 3, a determination is made, at a next step 126, if a cell transition has occurred wherein the current active cell is different than the most recent prior active cell. If a cell transition has occurred, the BLM value within the active cell will not be updated for cylinder balancing in accord with this invention. Accordingly, the pointers, sums, and stored values used for cylinder balancing in the routine of FIG. 3 are reset to initial values, such as zero at a next step 176, and general engine control and diagnostics operations required in the current reference pulse interrupt are then carried out via a step 170. Such control and diagnostics routines include the operations of FIG. 4, to be described.

Returning to step 126, if a cell transition is determined to not have occurred, a determination of whether the current reference pulse corresponds to a cylinder exhaust event is made at a next step 128. If the current reference pulse corresponds to a cylinder exhaust event, synchronized reading of individual cylinder air/fuel ratio is carried out. Otherwise, new information indicating individual cylinder air/fuel ratio is not yet available, and the described step 170 is carried out. In this manner, the reading of the oxygen sensor or sensors, such as the sensors 50–54 of FIG. 1 is carried out in a synchronous manner, synchronized with individual cylinder exhaust events, wherein the sensor corresponding to the cylinder undergoing its exhaust event is read and the sensor value attributed to such cylinder as a direct indication of the air/fuel ratio of that cylinder, substantially undiluted by air/fuel ratio information from other cylinders. Accordingly, if an exhaust event has occurred, the output signal from the oxygen sensor corresponding to the current active cylinder (the cylinder undergoing its exhaust event) is next read at a step 130, and is added to a sum of such read values for the current active (or Ith) cylinder at a next step 132.

A pointer I is next updated at a step 134 to point to the next cylinder in the predetermined engine cylinder firing order to undergo an exhaust event. A determination is next made at a step 136 of whether a new engine cycle is starting. An engine cycle is defined in this embodiment as an engine operating period in which each cylinder undergoes a complete combustion cycle. An engine cycle starting point is defined in this embodiment as beginning with a first detected engine cylinder exhaust event for a first cylinder. Accordingly, a new cycle begins, as determined at the step 136, when that first cylinder is the next cylinder to undergo an exhaust event, and a stored cycle counter is then incremented at a next step 138 indicating completion of gathering of air/fuel ratio information for an entire engine cycle. If a new engine cycle is not determined to be beginning at the step 136, then further data gathering is required before the data may be processed to indicate individual cylinder air/fuel ratio, and the described step 170 is executed.

Returning to step 138, after the counter is incremented, it is compared, at a next step 140, to a predetermined count threshold MAXCYCLES, set to about thirty-two in this embodiment. If the counter exceeds MAXCYCLES, then enough air/fuel ratio information has been gathered to provide for an accurate determination of individual cylinder air/fuel ratio, and processing of the gathered air/fuel ratio information is carried out via steps 142–166. Specifically, the cylinder pointer I is reset to point to the first cylinder in the engine firing order at a next step 142. An average air/fuel ratio for the Ith cylinder is next generated at a step 144, such as by dividing the sum of the air/fuel ratio measurements (as generated at the described step 132) by the number of samples included in the sum, which is the value MAXCYCLES. The pointer I is next updated at a step 148 to point to the next engine cylinder, and the step 144 is repeated for such next cylinder. The steps 144 and 148 are repeated for all engine cylinders, and then, via the step 150, an overall air/fuel ratio average for all cylinders together AVGALL is calculated at a next step 152, for example as the simple average of the AVGA/F values determined at the repeated step 144. The pointer I is next reset to point to the first cylinder in the engine firing order at a step 154, and then the Ith average air/fuel ratio AVGA/F[I] is compared to the overall air/fuel ratio AVGALL at a step 156 to determine if the Ith cylinder, on average, is deviating significantly from the overall air/fuel ratio. A deviation indicates a cylinder is out of balance relative to the average of the others. Such cylinder is identified and compensated through a relative engine cylinder air/fuel ratio compensation process in accord with this invention. Additionally, an absolute engine air/fuel ratio control process is applied to drive overall engine air/fuel ratio toward a target air/fuel ratio, for example in a closed-loop control process. Accordingly, any individual cylinder air/fuel ratio deviation away from the overall engine air/fuel ratio that is improperly compensated through the absolute control process may be compensated through the relative cylinder air/fuel ratio control process, as provided in the operations of the routine of FIG. 3.

Specifically, if the average air/fuel ratio for the Ith cylinder is greater than the overall air/fuel ratio, a block learn multiplier BLM for the current active cell for the lookup table for the Ith cylinder is increased at a next step 158. The increase may be by a fixed amount or may vary, such as by an amount determined as a predetermined function of the amount of the difference between AVGA/F[I] and AVGALL. Returning to step 156, if AVGA/F[I] is not greater than AVGALL, a determination is made at a next step 160 as to whether AVGA/F[I] is less than the overall air/fuel ratio AVGALL.

If AVGA/F[I] is less than AVGALL, then the BLM value for the current active cell for the current cylinder lookup table is decreased at a step 162. The amount of the BLM value decrease may be fixed or may vary, as described at the step 158. After adjusting the BLM value at either of the steps 158 or 162, or if AVGA/F[I] is not less than AVGALL at the step 160, than the BLM value for the current active cell is limited at a next step 164 to predetermined BLM limit values. A next step 166 is then executed to return and carry out the described steps 156–164 for all engine cylinders except a reference cylinder by pointing, via a step 174 to each cylinder individually, and then adjusting, if necessary, and limiting the BLM values for the active cell for each cylinder.

A reference cylinder is identified in this embodiment, and is excluded from the relative cylinder air/fuel ratio control process to provide a reference cylinder air/fuel ratio that operates to prevent drift in the correction for the other of the engine cylinders. The reference cylinder contributes to generation of the value AVGALL, but has no lookup table to be updated through the steps 156–164 of FIG. 3, so that the air/fuel ratio for the reference cylinder is only influenced by the absolute air/fuel ratio control process of this embodiment. Accordingly, after updating, if necessary, the BLM value for the active cell for each cylinder except the reference cylinder, the routine proceeds from the step 166 to a next step 168 to reset the pointer I, and the sums and stored values to initial values, such as to zero, to allow for a subsequent execution of the averaging of air/fuel ratio values and application of such value for individual cylinder balancing in accord with this invention through the operations of FIG. 3, as described.

The routine then proceeds to carry out the described step 170 to execute general engine control and diagnostics operations. Such operations include conventional control, diagnostics and maintenance operations as well as the operations of the routine of FIG. 4 which begin, upon being initiated at the step 170 of FIG. 3, at a step 300 and proceed to a step 302 to determine if the current reference pulse interrupt corresponds to an engine fueling event in which a fueling command for an individual cylinder is determined and issued in the form of a fuel injector pulse width command PW to the fuel control module 42 of FIG. 1. For example, a fueling event is present in this embodiment during the expansion stroke of any engine cylinder for injecting fuel to the intake runner of such cylinder. If the current reference pulse interrupt does not correspond to a fueling event, certain conventional engine control and diagnostic operations are carried out via a next step 304, such as operations that are executed during portions of the engine operating cycle other than during cylinder compression strokes. For example, such operations may include ignition and engine intake air control operations and conventional operations to diagnose fault conditions in engine components or control processes, as are generally known in the art. After completing such operations, the routine of FIG. 4 returns, via a next step 324, to the operations of FIG. 3.

Returning to step 302, if the current reference pulse interrupt corresponds to an engine fueling event, fuel control operations are carried out including the steps 306–322. Specifically, a determination is made at a first step 306 as to whether closed-loop engine control operations are currently active. Closed-loop operations are generally known in the art to correspond to closed-loop control of engine air/fuel ratio responsive to a feedback signal indicating actual cylinder air/fuel ratio, such as provided by sensors 50–54 of FIG. 1. Closed-loop control may be active during normal engine operation when closed-loop control components including air/fuel ratio sensors are active. If closed-loop is determined to be active at the step 306, a value representing overall engine air/fuel ratio is determined at a next step 308, such as a predetermined function of the value AVGALL of step 152 of FIG. 3, or a like value. An air/fuel ratio error is next calculated at a step 310 as a difference between overall air/fuel ratio as determined at the step 308 and a predetermined target air/fuel ratio, such as the well-known stoichiometric ratio. A base fuel pulse width representing a time of opening of a next active fuel injector for injecting pressurized fuel to the engine cylinder undergoing its expansion stroke is next determined at a step 314 as a predetermined function of the determined air/fuel ratio error. For example, in a proportional-plus-integral-plus-derivative control approach, the overall air/fuel ratio error is applied to a predetermined classical control function for determining an appropriate base fuel pulse width, which may include a prior pulse width combined with a pulse width change determined through the PID control function, as is well-known in the art. Block learn information from an active cell for a BLM table for controlling overall engine air/fuel ratio may additionally be applied as a simple multiplier to correct the base pulse width. The BLM values in the table may be adapted when active through any conventional approach, or through the approach described for the individual cylinder BLM tables of this embodiment.

Returning to step 306, if closed-loop control is determined to not be active, an open loop fuel pulse width is determined at a next step 312 as a predetermined function of a target engine air/fuel ratio and an estimate of cylinder intake air charge. Next, or following determination of the closed-loop base pulse width, a determination is made at a step 316 as to whether block learn compensation for individual engine cylinder balancing in a relative engine cylinder air/fuel ratio control process in accord with this invention is active. Such block learn compensation will be active when the cell transition condition described at step 126 of FIG. 3 is not present. If block learn is active, as determined at the step 316, the block learn multiplier BLM is referenced from the active cell for the active cylinder (the cylinder undergoing its expansion stroke) at a next step 318. If the active cylinder is the reference cylinder, no block learn multiplier will be available, as described. However, in an alternative embodiment of this invention, the inventor provides for correction of all engine cylinders including the reference cylinder through the relative engine cylinder air/fuel ratio control process of this invention.

Returning to FIG. 4, the base pulse width, determined at either step 314 or 312 is then corrected by applying the BLM value from step 318 to the base pulse width, such as in the form of a direct multiplier at a next step 320. Next, or if block learn compensation is determined to not be active at the step 316, the fuel pulse width is output to the fuel control module 42 (FIG. 1) at a step 322. The fuel control module will then, at a predetermined position within an engine cycle and before the intake stroke for the active cylinder, drive the fuel injector corresponding to the active cylinder to an open position for a period of time calibrated to correspond to the determined pulse width. The block learn correction applied at step 320 will drive, if necessary, the air/fuel ratio of the active cylinder toward the overall engine air/fuel ratio which, in this embodiment, is independently controlled to a target air/fuel ratio, such as the stoichiometric ratio, to provide for individual cylinder air/fuel ratio balancing pursuant to improved engine emissions. After outputting the pulse width at the step 322, the described step 324 is executed to return to the operations of FIG. 3 from which the routine of FIG. 4 was initiated.

The inventors intend that various alternative embodiments are within the scope of this invention. For example, all engine cylinders may be balanced through the operations of FIGS. 3 and 4 without use of a reference cylinder, wherein each cylinder has a stored block learn multiplier table associated with it and the individual BLM values are gradually updated to account for changing control conditions. Additionally, individual cylinders may be controlled independently toward a common target air/fuel ratio, such as the stoichiometric ratio, to provide for individual cylinder absolute air/fuel ratio control and balancing without a need for an independent relative cylinder air/fuel ratio control process for balancing. The measured individual cylinder air/fuel ratio values would then be applied, for example during each cylinder expansion stroke, in an individual cylinder BLM value adjustment for the current active cylinder, and the adjusted BLM value applied (when BLM compensation is active) to correct a base pulse width for application only to the current active cylinder.

The inventors further intend the averaging scheme for determining individual cylinder air/fuel ratio of steps 144 of FIG. 3 and the averaging scheme of step 152 for determining a value representing overall engine air/fuel ratio is simply one example of how such representative values may be determined. It is intended that conventional integration processing, lag filter processing, or higher order filter processing may be applied to air/fuel ratio measurements to arrive at values representing individual cylinder air/fuel ratio or overall engine air/fuel ratio within the scope of this invention.

The preferred embodiment for the purpose of explaining this invention is not to be taken as limiting or restricting the invention since many modifications may be made through the exercise of ordinary skill in the art without departing from the scope of the invention.

The embodiments of the invention in which a property or privilege is claimed are described as follows:

1. An engine control method for balancing an air/fuel ratio of a plurality of cylinders of a multiple cylinder internal combustion engine, comprising the steps of:

estimating actual air/fuel ratio of individual engine cylinders;

determining a target cylinder air/fuel ratio as a predetermined function of the estimated actual air/fuel ratio of the individual engine cylinders;

comparing the estimated actual air/fuel ratio of each of the plurality of engine cylinders to the target cylinder air/fuel ratio;

detecting a deviation between the estimated actual air/fuel ratio of any of the plurality of engine cylinders and the target cylinder air/fuel ratio; and for a cylinder of the plurality of engine cylinders in which a deviation is detected, varying a cylinder control command to drive the estimated actual air/fuel ratio of the cylinder toward the target air/fuel ratio.

2. The method of claim 1, wherein the determining step determines the target cylinder air/fuel ratio as an average of the estimated actual air/fuel ratio of the individual engine cylinders.

3. The method of claim 1, wherein each engine cylinder has an exhaust gas runner through which cylinder exhaust gas passes, and wherein the estimating step further comprises the steps of:

providing an exhaust gas sensor in proximity to the exhaust gas runner for at least one engine cylinder, the exhaust gas sensor producing an output signal indicating individual cylinder air/fuel ratio;

sensing occurrence of a cylinder exhaust event in which exhaust gas is passed from a cylinder through its corresponding exhaust gas runner; and sampling the exhaust gas sensor output signal upon sensing occurrence of the cylinder exhaust event.

4. The method of claim 1, wherein each engine cylinder has an exhaust gas runner through which cylinder exhaust gas passes, and wherein the estimating step further comprises the steps of:

providing an exhaust gas sensor in proximity to the exhaust gas runner for each engine cylinder, the exhaust gas sensor for each engine cylinder producing an output signal indicating air/fuel ratio of the corresponding cylinder;

sensing a cylinder exhaust event in which exhaust gas is passed from a cylinder through its corresponding exhaust gas runner; and sampling, upon sensing the cylinder exhaust event, the output signal of the exhaust gas sensor corresponding to the cylinder in which the exhaust event is sensed.

5. The method of claim 1, further comprising the steps of:

storing a block learn table for each of the plurality of engine cylinders, each block learn table being comprised of block learn cells containing air/fuel ratio correction values, each of the cells stored in the table as a function of predetermined engine operating parameters;

and wherein the step of varying a cylinder control command further comprises the steps of (a) identifying an active cylinder from the plurality of engine cylinders, (b) identifying an active cell of the block learn table corresponding to the active cylinder, (c) varying the air/fuel ratio correction value of the active cell in direction to drive the estimated actual air/fuel ratio toward the target cylinder air/fuel ratio for the active cylinder, and (d) applying the varied air/fuel ratio correction value to a cylinder fueling command to vary the quantity of fuel delivered to the active engine cylinder.

6. The method of claim 5, wherein the step of identifying an active cylinder further comprises the steps of:

determining an occurrence of a cylinder exhaust event during which cylinder exhaust gas is passed out of the engine cylinder; and identifying the cylinder in which the exhaust event occurred as the active engine cylinder.

7. The method of claim 5, wherein the step of identifying an active cell further comprises the steps of:

sampling current values of the predetermined engine operating parameters;

referencing the cell of the block learn table of the active engine cylinder that corresponds to the sampled current values as the active cell.

8. The method of claim 1, further comprising the steps of:

generating a value representing overall actual engine air/fuel ratio;

providing a desired engine air/fuel ratio;

calculating an overall air/fuel ratio deviation value as a function of a difference between overall actual engine air/fuel ratio and desired engine air/fuel ratio;

generating the cylinder control command as a predetermined function of the overall air/fuel ratio deviation value;

controlling air/fuel ratio of the engine cylinders in accordance with the generated cylinder control command.

9. A control method for minimizing variation in actual air/fuel ratio between the cylinders of a multiple cylinder internal combustion engine, comprising the steps of:

estimating individual cylinder actual air/fuel ratio over a test period;

generating an engine air/fuel ratio value representing actual engine air/fuel ratio as a function of the estimated individual cylinder actual air/fuel ratio; and for each of a plurality of engine cylinders, (a) determining a difference between the estimated actual air/fuel ratio for the cylinder and the generated engine air/fuel ratio value, (b) comparing the determined difference to a difference threshold, (c) varying an air/fuel ratio control command for the cylinder if the determined difference exceeds the difference threshold, and (d) controlling air/fuel ratio of the cylinder in accord with the varied air/fuel ratio control command.

10. The method of claim 9, wherein an exhaust manifold is positioned to receive exhaust gas passed out of the engine cylinders, and wherein the estimating step further comprises the steps of:

positioning at least one exhaust gas oxygen sensor in the exhaust manifold, the exhaust gas oxygen sensor outputting a signal indicating exhaust gas oxygen content;

determining a time of occurrence of a cylinder exhaust event when exhaust gas is passed out of an engine cylinder;

sampling the signal following the determined time of occurrence as an indication of exhaust gas oxygen content of the cylinder undergoing a cylinder exhaust event; and estimating the air/fuel ratio of the cylinder undergoing the cylinder exhaust event as a function of the signal sample.

11. The method of claim 9, wherein each engine cylinder includes an exhaust gas runner through which cylinder exhaust gas is guided out of the corresponding cylinder during a cylinder exhaust event, and wherein the estimating step further comprises the steps of:

disposing an oxygen sensor in the exhaust runner of each of the engine cylinders, each oxygen sensor for transducing the oxygen content of the corresponding engine cylinder exhaust gas into a sensor output signal;

sensing a cylinder exhaust event;

sampling the output signal of the oxygen sensor corresponding to the cylinder in which an exhaust event is sensed upon sensing the cylinder exhaust event; and estimating the cylinder air/fuel ratio as a function of the sampled output signal.

12. The method of claim 9, wherein the generating step generates the engine air/fuel ratio value as an average of the estimated individual cylinder actual air/fuel ratio.

13. The method of claim 9, further comprising the steps of:

providing, for each of the plurality of engine cylinders, a stored schedule of air/fuel ratio correction values, wherein each correction value is stored in its corresponding schedule as a function of an engine operating level;

sensing a current active engine cylinder;

sensing a current engine operating level, selecting a correction value corresponding to the current engine operating level from the stored schedule corresponding to the current active engine cylinder;

wherein the varying step varies the selected correction value in direction to minimize the determined difference, and wherein the step of controlling air/fuel ratio further comprises the steps of:

applying the varied correction value to a cylinder air/fuel ratio control command for the active engine cylinder to vary the cylinder air/fuel ratio control command; and outputting the varied cylinder air/fuel ratio control command to control air/fuel ratio of the active engine cylinder.

14. The method of claim 9, further comprising the steps of:

referencing a desired engine air/fuel ratio value;

calculating air/fuel ratio error as a difference between the desired engine air/fuel ratio and a predetermined function of the generated engine air/fuel ratio value; and generating the air/fuel ratio control command as a predetermined function of the error.

* * * * *